US006364217B1

(12) United States Patent
Lockwood

(10) Patent No.: US 6,364,217 B1
(45) Date of Patent: Apr. 2, 2002

(54) REVERSING GEAR DRIVE SYSTEM FOR IRRIGATION SPRINKLERS

(75) Inventor: George H. Lockwood, Pompano Beach, FL (US)

(73) Assignee: Rain Bird Corporation, Glendora, CA (US)

( * ) Notice: Subject to any disclaimer, the term of this patent is extended or adjusted under 35 U.S.C. 154(b) by 0 days.

(21) Appl. No.: 09/565,600

(22) Filed: May 4, 2000

Related U.S. Application Data

(60) Provisional application No. 60/134,998, filed on May 20, 1999.

(51) Int. Cl.[7] ..... B05B 3/04

(52) U.S. Cl. ..... 239/242; 239/206; 239/237; 239/240; 239/263.3; 74/354

(58) Field of Search ..... 239/225.1, 237, 239/240, 241, 242, 263, 263.3, 205, 206; 74/354, 384

(56) References Cited

U.S. PATENT DOCUMENTS 3,107,056 A * 10/1963 Hunter ..... 239/242 X
3,713,584 A * 1/1973 Hunter ..... 239/206
3,724,757 A * 4/1973 Hunter ..... 239/205
4,708,291 A * 11/1987 Grundy ..... 239/242
5,148,991 A * 9/1992 Kah, Jr. ..... 239/242
5,383,600 A * 1/1995 Verbera et al. ..... 239/263.3 X
5,676,315 A * 10/1997 Han ..... 239/206 X
6,042,021 A * 3/2000 Clark ..... 239/242 X

* cited by examiner

*Primary Examiner*—Steven J. Ganey
(74) *Attorney, Agent, or Firm*—Kelly Bauersfeld Lowry & Kelley, LLP

(57) ABSTRACT

A reversing gear drive system is provided in an irrigation sprinkler for reversibly shifting the direction of rotation of a sprinkler spray head for back and forth part-circle rotation between adjustably set end limits, to sweep an outwardly projected stream of irrigation water through a predetermined arcuate pattern to irrigate a surrounding terrain area and associated vegetation. The reversing gear drive system includes a gear carrier having first and second output gears driven rotatably in opposite directions. A shift mechanism is provided for shifting the gear carrier between forward-drive and reverse-drive positions with the first and second output gears alternately engaged with a ring gear for rotatably driving the spray head in opposite directions. The shift mechanism includes a shift lever and a reverse trip spring for engaging arcuately spaced limit stops mounted for rotation with the spray head. As one of the limit stops rotates into engagement with the shift mechanism, the limit stop initially engages and loads the trip spring to apply a reversing shift force to the shift lever, and then engages and retracts a latch to release the shift lever for spring-loaded shifting of the gear carrier to reverse the direction of spray head rotation. Upon such reversal, the latch re-engages the shift lever to positionally retain the gear carrier until the opposite limit stop rotates into engagement with the shift mechanism.

29 Claims, 4 Drawing Sheets

REVERSING GEAR DRIVE SYSTEM FOR IRRIGATION SPRINKLERS

RELATED APPLICATION

This application claims the benefit of copending Provisional Application Ser. No. 60/134,998, filed May 20,1999.

BACKGROUND OF THE INVENTION

This invention relates generally to irrigation sprinklers of the type having a rotatably driven spray head for projecting one or more streams of irrigation water over a surrounding terrain area and associated vegetation. More particularly, this invention relates to an improved reversing gear drive system for reversing the direction of spray head rotation back and forth within the range of a predetermined part-circle arcuate path.

Irrigation sprinklers of the type having a rotatably driven spray head are generally known in the art, wherein the spray head includes at least one spray nozzle through which a stream of irrigation water is projected outwardly to irrigate surrounding terrain and associated vegetation. In such sprinklers, the spray head is rotated about a vertical axis and may be reversibly driven with an oscillating or back and forth motion between adjustably set end limits to sweep the water stream over an arcuate, part-circle terrain area. Rotary drive power is commonly produced by a turbine motor having a water-driven turbine adapted to be driven by some or all of the water flowing through the sprinkler to the spray head. This turbine typically comprises a relatively high speed and relatively low torque device, and provides a rotary input to a reduction gear unit which produces a relatively low speed and relatively high torque output for rotatably driving the spray head.

Within or following this reduction gear unit, a reversing gear mechanism is provided for reversing the direction of spray head rotation. One common means for achieving spray head reversal is disclosed in U.S. Pat. No. 3,107,056, and comprises a shiftable gear carrier including an input drive gear coupled via a suitable number of idler gears to rotatably drive a pair of output gears in opposite directions. This arrangement is commonly referred to as an "odd gear" or "odd idler" system since the number of idler gears associated respectively with the two output gears must differ by an odd number, such as one, to rotatably drive the output gears in opposite directions. The gear carrier is adapted for shifting between a first or forward-drive position with one of the output gears engaging and driving a ring gear or the like coupled to the spray head, and an alternative second or reverse-drive position with the other output gear engaging and driving the ring gear. A toggle or shifting lever on the gear carrier is contacted by a pair of limit stops mounted for rotation with the spray head to shift the gear carrier between the forward-drive and reverse-drive positions. In this manner, the spray head is reversibly rotated to sweep the water stream back and forth over the prescribed part-circle terrain pattern. The arcuate width of the irrigated terrain pattern may be adjustably selected by adjusting the arcuate spacing between the pair of limit stops.

Such reversing gear mechanisms have been subject to undesirable stalling or locking up without proper shifting between the forward-drive and reverse-drive positions. More particularly, since the reversing gear mechanism cannot operate with both output gears simultaneously engaged with the ring gear to drive the spray head, there is an inherent intermediate neutral position during shifting wherein both output gears are at least momentarily disengaged from the ring gear. In an effort to prevent undesirable stalling of the gear carrier in this neutral position, over-center spring arrangements have been provided to load the gear carrier and/or the toggle lever in a manner intended to positively displace the gear carrier through this neutral position.

However, over-center spring arrangements have not been completely successful in eliminating gear carrier stalling. In this regard, spring-loaded displacement of the gear carrier through the neutral position requires a spring force exceeding resistance forces such as frictional resistance attributable to accumulation of dirt and grit between moving parts. The applied spring force for shifting must also exceed reaction forces interacting between each output gear and the ring gear tending to cause those gears to resist disengagement. Whenever the frictional resistance and/or reaction forces exceed the applied spring force for shifting, stalling can occur. Unfortunately, in an over-center spring arrangement, the applied spring force is smallest at the moment of initial shifting displacement of the gear carrier, whereby relatively small resistance forces at this moment of initial gear carrier displacement can therefore cause stalling to occur. Alternative reversing mechanism designs have generally been more complex with additional moving parts, but have not satisfactorily overcome the problem. See, for example, U.S. Pat. Nos. 4,568,024; 4,901,924; 5,673,855; and 4,955,542.

There exists, therefore, a need for an improved reversing mechanism for reversibly driving a spray head in an irrigation sprinkler or the like, wherein the reversing mechanism is not subject to undesirable stalling. The present invention fulfills this need and provides further related advantages.

SUMMARY OF THE INVENTION

Based on the foregoing, it is a primary object of the present invention to provide an improved reversing gear drive system.

It is also an object of the present invention to provide an improved reversing gear drive system that virtually eliminates or greatly reduces the risk of stalling when a mechanical shift mechanism displaces through a neutral position to change the direction of rotation.

It is another object of the present invention to provide an improved reversing gear drive system that reduces the number of moving parts in the mechanical shift mechanism.

It is an additional object of the present invention to provide an improved reversing gear drive system that may be adapted to sprinklers and other rotating devices that require a reversal of direction.

It is still anther object of the present invention to provide an improved reversing gear drive system that reduces the number of components and provides more space and greater clearance such as for accommodating a conduit in a sprinkler or the like for carrying water.

It is a further object of the present invention to provide an improved reversing gear drive system that is more reliable and durable in comparison with prior art systems.

In accordance with the invention, an improved reversing gear drive system is provided for use in an irrigation sprinkler or the like, of the type having a rotatably driven spray head for sweeping an outwardly projected stream of irrigation water over a surrounding terrain area and associated vegetation. The reversing gear drive system comprises a gear carrier having first and second output gears driven rotatably in opposite directions. A shift mechanism is provided for shifting the gear carrier between forward-drive and reverse-drive positions with the first and second output gears alternately engaged with a ring gear or the like for rotatably driving the spray head in opposite directions. The shift mechanism includes a shift lever and a reverse trip spring coupled to the gear carrier for engaging arcuately spaced limit stops mounted for rotation with the spray head.

As one of the limit stops rotates into engagement with the shift mechanism, the limit stop initially engages and loads the trip spring to apply a reverse shift force to the shift lever, and then engages and retracts a latch to release the shift lever for spring-loaded gear carrier shifting to reverse the direction of spray head rotation. Upon such reversal, the latch re-engages the shift lever to positionally retain the gear carrier until the opposite limit stop rotates into engagement with the shift mechanism.

In a preferred form, the first and second output gears on the gear carrier are positioned for respective meshed engagement with a ring gear coupled to and rotatably driving the spray head. The limit stops are mounted for rotation with the ring gear, and one or both of the limit stops may be adjustably set to define a predetermined part-circle arcuate path of motion for the spray head. In the preferred form, the latch is spring-loaded to engage and retain the shift lever in the forward-drive or reverse-drive position with the respective one of the first and second output gears in driving engagement with the ring gear. As each limit stop rotates into engagement with the shift mechanism, the limit stop initially engages and loads the reverse trip spring while the latch retains the gear carrier in the set drive position for continued spray head rotation. Thereafter, a ramped cam on the limit stop engages and retracts the latch to a position disengaged from the shift lever to permit the loaded trip spring to displace the shift lever and thereby move the gear carrier through a neutral position to the opposite drive position for rotatably driving the spray head in an opposite rotational direction. Importantly, the magnitude of the torque applied by the reverse trip spring to shift the gear carrier is a maximum at the moment of initial shifting displacement.

In the event that resistance forces such as friction act to resist the desired spring-loaded shifting displacement of the gear carrier upon latch retraction, each limit stop is additionally provided with a stop tab for engaging and initiating movement of the shift lever. Further rotational driving of the spray head subsequent to latch retraction moves the stop tab against the shift lever to positively initiate shifting displacement thereof toward the opposite drive position. As soon as this displacement starts, any resistance forces are overcome and the reverse trip spring drives the gear carrier with a positive action to the opposite drive position.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
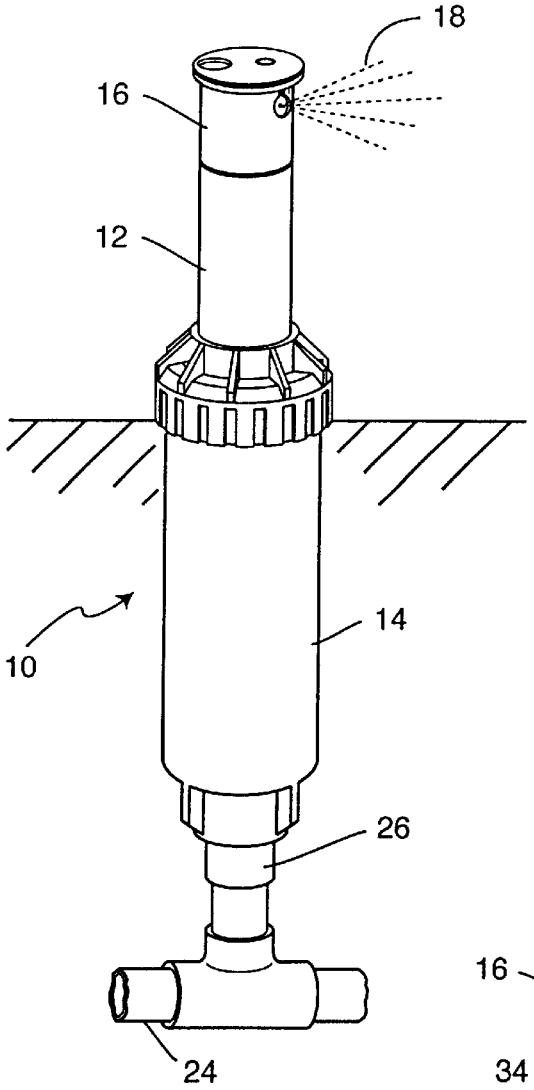
FIG. 1 is a fragmented perspective view of a rotary drive pop-up sprinkler of a type incorporating a reversing gear drive system embodying the novel features of the invention.
Figure 2:
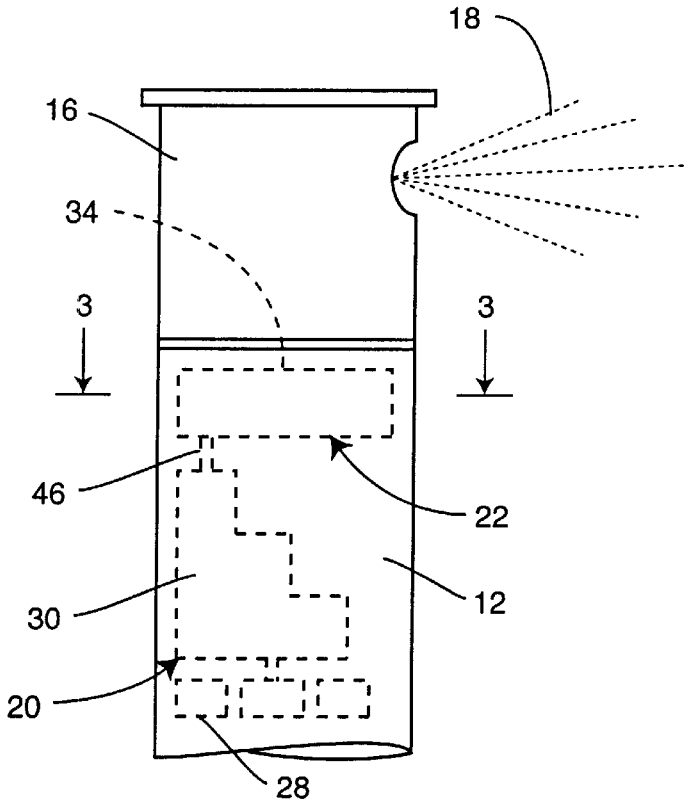
FIG. 2 is an enlarged fragmented side elevation view depicting a pop-up riser of the rotary drive sprinkler, equipped with a rotatably driven spray head.

As shown in the exemplary drawings, a pop-up and rotary drive irrigation sprinkler is referred to generally in FIG. 1 by the reference numeral 10. The sprinkler 10 includes a tubular pop-up riser 12 mounted within a sprinkler housing or case 14 and carrying a spray head 16 at an upper end thereof for projecting a stream 18 of irrigation water outwardly over a selected surrounding terrain area and associated vegetation. A rotary drive mechanism 20 (FIG. 2) is mounted within the riser 12 for rotatably driving the spray head 16 in a manner to sweep the projected water stream 18 over the surrounding terrain. In accordance with the invention, the rotary drive mechanism 20 incorporates an improved reversing gear drive system 22 (FIGS. 2–8) for reversibly shifting the direction of spray head rotation for back and forth part-circle rotation between adjustably set end limits, to sweep the projected water stream 18 through a predetermined part-circle arcuate pattern.

The illustrative pop-up and rotary drive sprinkler 10 has a generally conventional overall construction and operation to sweep the outwardly projected water stream 18 over a selected target terrain area. More particularly, the sprinkler case 14 has a generally upright cylindrical configuration with the tubular riser 12 mounted slidably therein for movement between a normal inoperative position (not shown) retracted into and substantially concealed within the case 14, and an elevated spraying position (FIG. 1) with the spray head 16 at the riser upper end disposed in spaced relation above the sprinkler case 14. In this regard, as is known in the art, the riser 12 is shifted upwardly to the elevated spraying position in response to inflow of water under pressure supplied from a water supply line 24 to the sprinkler interior through an inlet fitting 26 located typically at the bottom or lower end of the sprinkler case.

The rotary drive mechanism 20 for the pop-up sprinkler 10 may be mounted within a lower region of the tubular riser 12 and responds to the inflow of pressurized water to rotate the spray head 16 to sweep the outwardly projected water stream 18 over a surrounding terrain area. This rotary drive mechanism 20 is shown schematically in FIG. 2 to include a turbine 28 which is rotatably driven by some or all of the pressurized water flow passing through the sprinkler case 14 to the spray head 16. The water turbine 28 provides a relatively high speed and low torque rotary drive input to mechanically drive a multi-gear reduction gear unit 3O which produces a relatively low speed and high torque rotary drive output for rotatably driving the spray head 16. The reversing gear drive system 22 is coupled between the reduction gear unit 30 and the spray head 16 for reversing the direction of spray head rotation at end limits which can be adjustably set so that the spray head 16 rotates back and forth within predetermined limits of a part-circle arcuate path. For examples of rotary drive pop-up sprinklers of this general type, see U.S. Pat. Nos. 3,107,056; 3,724,757; 4,568,024; 4,718,605; 4,787,558; and 5,383,600. In addition, such sprinklers are commercially available from Rain Bird Sprinkler Mfg. Corp. of Glendora, Calif. under the product designations T-Bird Series, 3500 Series, R-50 Series, Falcon, and Talon.

The improved reversing gear drive system 22 of the present invention provides reliable and positive-action reversal of the spray head drive direction. More specifically, the improved reverse gear driving system 22 incorporates an improved shift mechanism 32 (FIGS. 3–8) having a minimum number of moving parts and adapted to shift between a first or forward-drive position and a second or reverse-drive position substantially without risk of the shift mechanism stalling in an intermediate neutral position or otherwise hanging up or locking up without proper shifting. The shift mechanism 32 is positively displaced between the forward-drive and the reverse-drive positions with a spring action, wherein the applied spring torque is a maximum at the moment of initial shifting displacement.

FIGS. 3–8 illustrate the construction and operation of the improved reverse gear driving system in accordance with a preferred form, wherein the reverse gear driving system is adapted for reversibly driving an internally toothed ring gear 34 positioned generally within an upper end of the riser 12 and suitably connected in a known manner to the overlying spray head 16 for rotatably driving the spray head. The ring gear 34 is associated with a pair of limit stops 36 and 38 mounted thereon or otherwise suitably mounted in a known manner on the spray head 16 for rotation therewith. These limit stops 36, 38 are positioned to engage the shift mechanism 32, as will be described in more detail, and define the opposite end limits of the part-circle rotational path of the spray head. One or both of these limit stops 36 and 38 may be adjustably set in a manner known in the art to adjustably select the arcuate width of this part-circle rotational path.

The shift mechanism 32 reversibly positions a gear carrier 40 between forward-drive and reverse-drive positions to reversibly drive the spray head 16. The gear carrier 40 is provided in the form of a support plate 42 having a plurality of upstanding pinion gears rotatably mounted thereon. One of these gears comprises a drive gear 44 mounted on a drive shaft 46 which is shown (FIG. 2) to extend downwardly through the support plate 42 and is rotatably driven by the reduction gear unit 30. The drive gear 44 is meshed on opposite sides via idler gears 48 respectively to a first output gear 50 and a second output gear 52. Importantly, the number of idler gears 48 disposed respectively between the drive gear 44 and the two output gears 50, 52 differs by an odd number, such as one, so that the two output gears 50, 52 are rotatably driven in opposite rotational directions.

The gear carrier 40 is positioned within the riser 12 at an off center or off-axis position generally adjacent to the toothed internal surface of the ring gear 34. In this position, the gear carrier 40 can be rotatably displaced through a short stroke about the vertical axis of the drive gear 44 for shifting movement between the forward-drive and the reverse-drive positions. More particularly, the gear carrier 40 can be set in the forward-drive position with the first output gear 50 in meshed engagement with the ring gear 34 (FIGS. 3–4), and with the second output gear 52 spaced from the ring gear in non-driving relation therewith. Alternately, the gear carrier 40 can be set in the reverse-drive position with the second output gear 52 in meshed engagement with the ring gear (FIG. 7), and with the first output gear 50 spaced from the ring gear in non-driving relation therewith. In the illustrative drawings, when the drive gear 44 is rotatably driven in a clockwise direction as shown, this results in clockwise rotational driving of the ring gear 34 and the spray head 16 in the forward-drive position, and counter-clockwise rotational driving in the reverse-drive position.

The shift mechanism 32 comprises a shift lever 54 coupled to the gear carrier 40 and movable between a first position for setting the gear carrier in the forward-drive position, and a second position for setting the gear carrier 40 in the reverse-drive position. The shift lever 54 extends from the gear carrier 40 generally to an opposite side of the riser 12 and terminates in a toggle arm 56 for engaging the limit stops 36,38 in the course of back and forth spray head rotation. In this regard, the gear carrier 40 is positioned generally at one side of the riser 12 at a position disposed radially outwardly from a central tubular conduit 58 through which water under pressure flows upwardly from the sprinkler case 14 to the spray head 16. The shift lever 54 has a generally U-shaped configuration to wrap about this central conduit 58 in a manner to avoid interference therewith, and terminates in the toggle arm 56 projecting generally radially outwardly at a location generally opposite the drive gear 44 on the gear carrier. Importantly, the shift lever 54 carries a reverse trip spring 60 mounted beneath the toggle arm 56 (FIG. 5) and projecting radially outwardly in generally parallel relation to the toggle arm, and in a cantilevered relation with respect to the shift lever 54. That is, the trip spring 60 has an inboard end anchored on the shift lever 54 beneath the toggle arm 56, and a free outboard end which terminates a short distance radially inwardly from a free outboard end of the toggle arm 56. In the preferred form, the trip spring 60 includes a spiral coil 60' (shown best in FIG. 5) intermediate a first leg anchored to the shift lever 54 and a free second leg projecting radially outwardly, although a linear-type cantilever spring or other types of springs may be employed.

Figure 3:
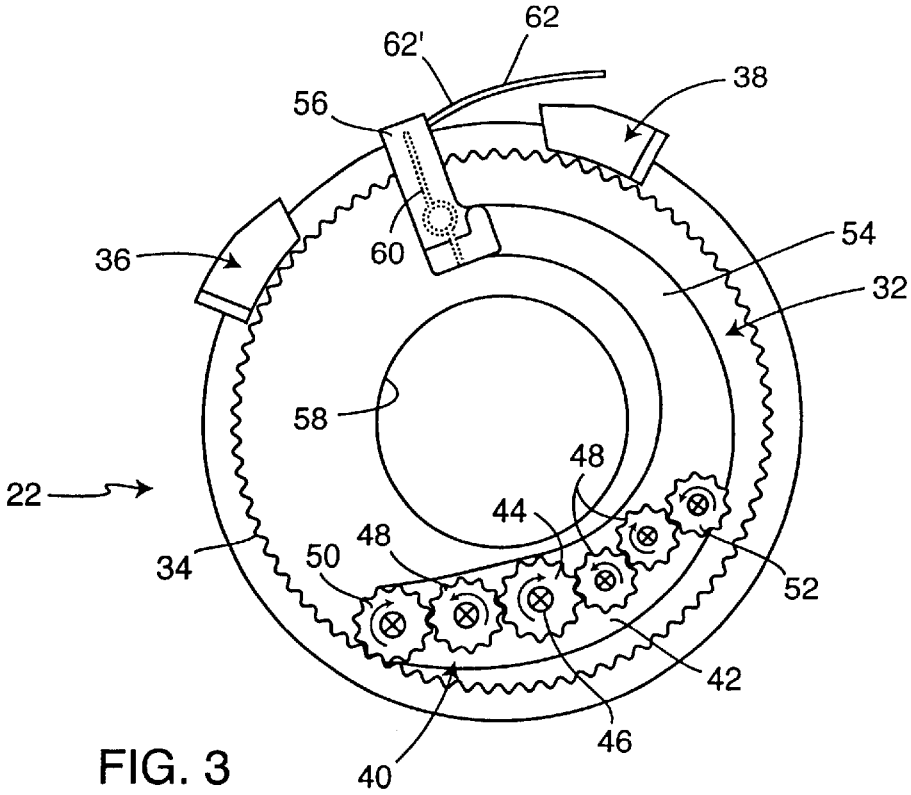
FIG. 3 is an enlarged fragmented horizontal sectional view taken generally on the line 3—3 of FIG. 2, and illustrating in somewhat schematic form rotatable driving of the spray head in a forward or clockwise direction between an arcuately spaced pair of limit stops.
Figure 4:
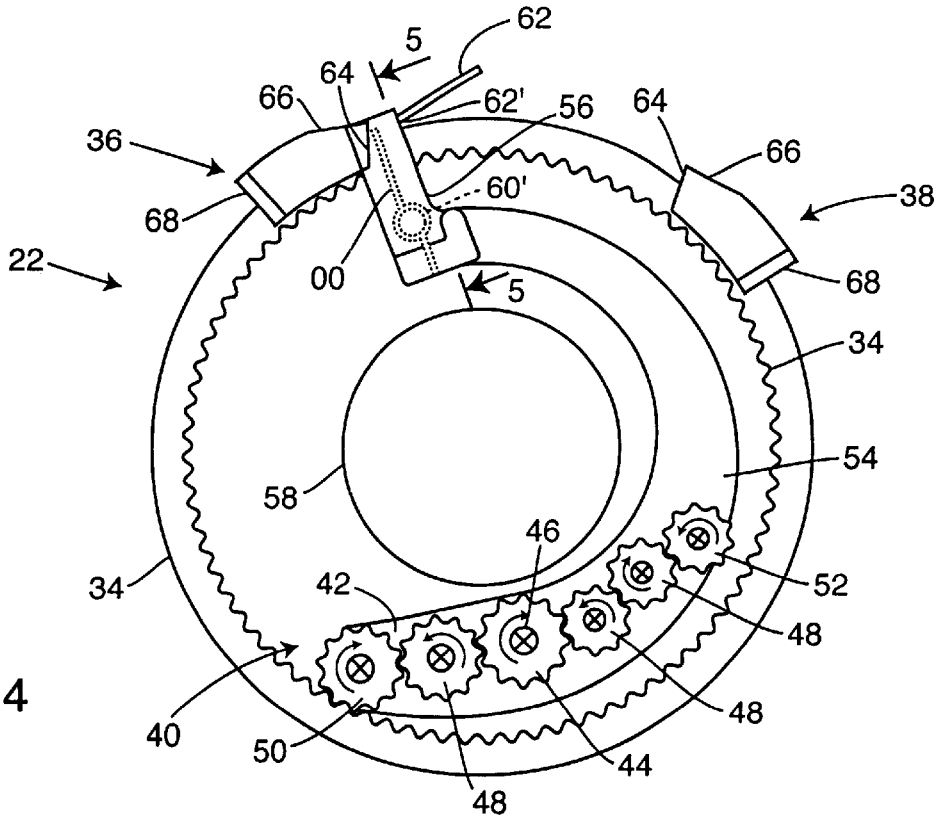
FIG. 4 is a sectional view similar to FIG. 3, and depicting initial engagement of a shift mechanism with one of the limit stops.
Figure 5:
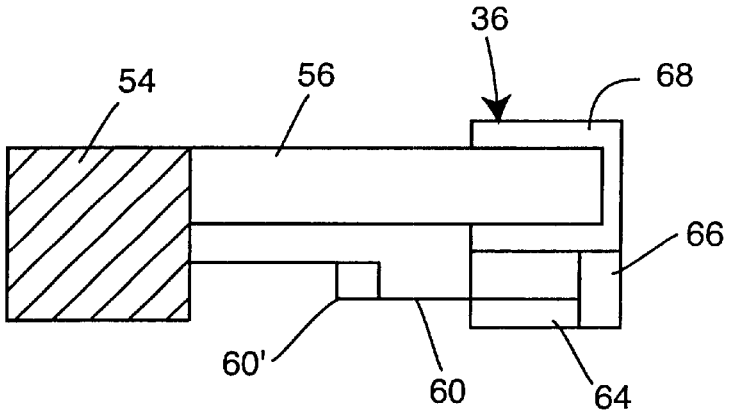
FIG. 5 is an enlarged fragmented vertical sectional view taken generally on the line 5—5 of FIG. 4.
Figure 6:
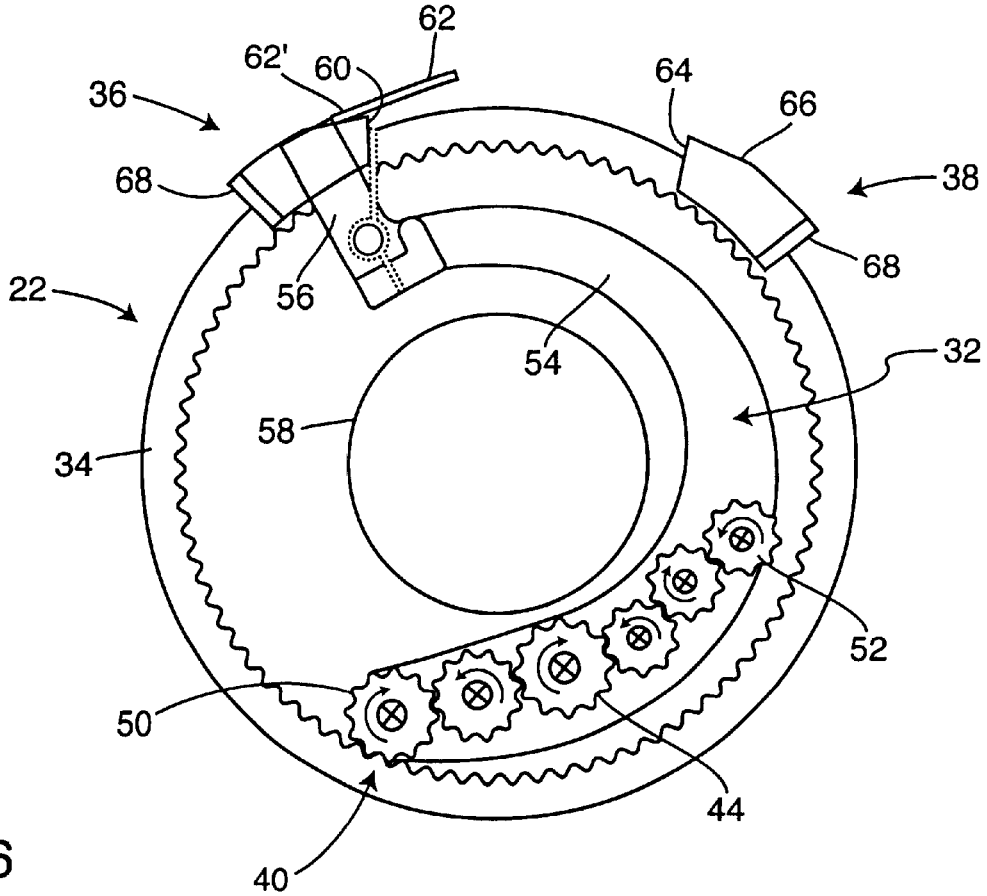
FIG. 6 is a sectional view similar to FIG. 4, and depicts further engagement of the shift mechanism with the limit stop to load a reverse trip spring.
Figure 7:
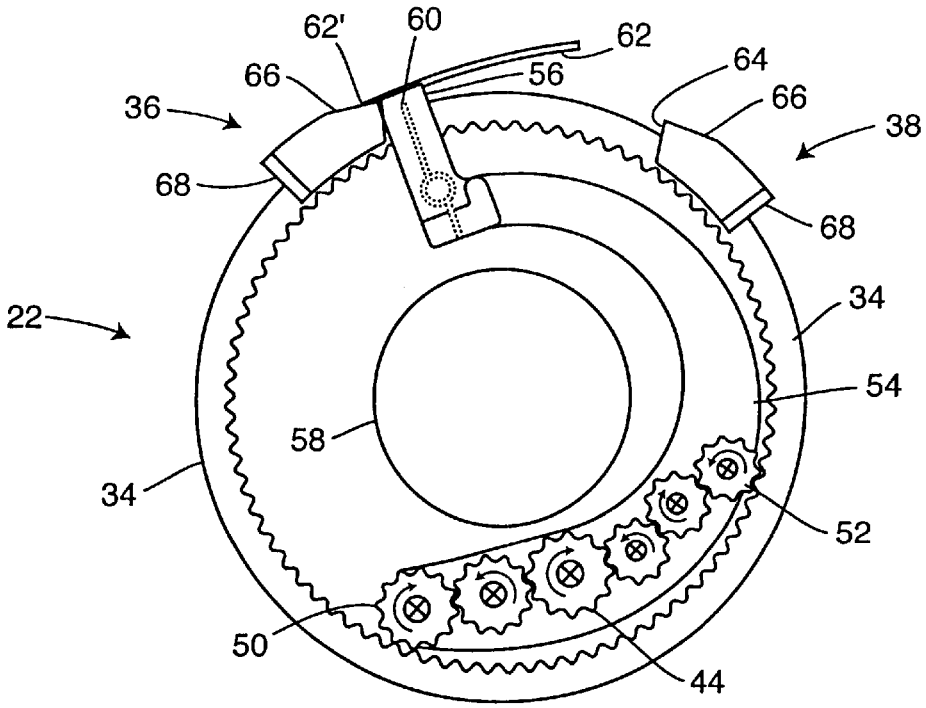
FIG. 7 is a sectional view similar to FIG. 6, and showing further engagement of the shift mechanism with the limit stop to retract a latch from engagement with a shift lever and thereby permit spring-loaded shifting to a reverse drive mode.
Figure 8:
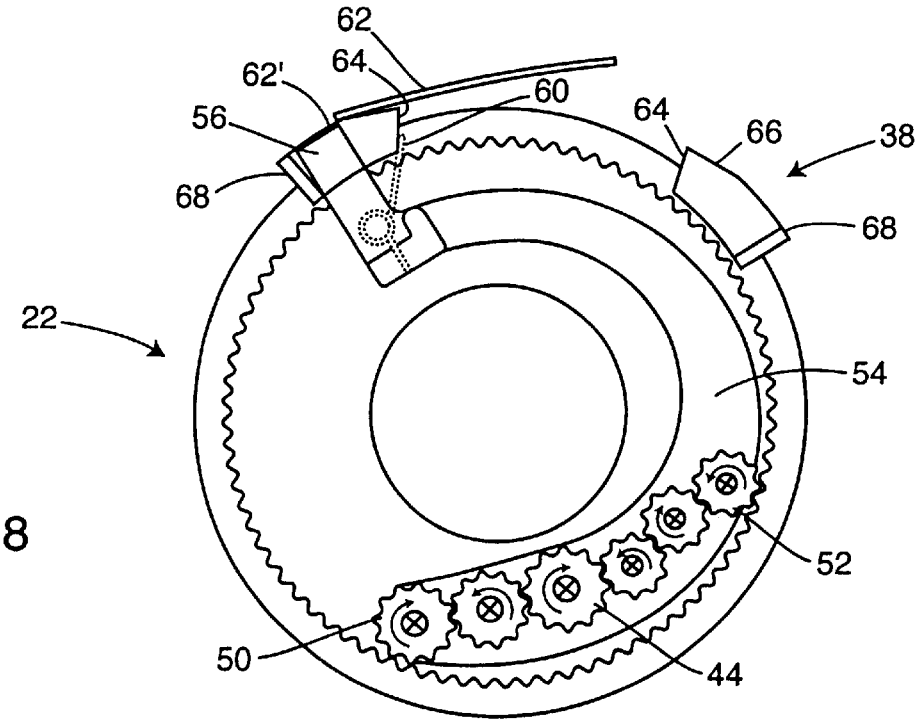
FIG. 8 is a sectional view similar to FIG. 6, and illustrating engagement of a stop tab on the limit stop with the shift lever to initiate shifting of the gear drive system.

A latch 62 is provided for releasibly retaining the shift mechanism 32 in the forward-drive or the reverse-drive position, according to the direction of spray head driving. The illustrative drawings show the latch 62 in the form of wire-type spring anchored on the riser 12 and having a downturned pin 62' for engaging one side of the toggle arm 56. FIGS. 3–4 and 6 shown the latch pin 62' engaging one side of the toggle arm 56 for retaining the shift lever 54 in a forward-drive position with the first output gear 50 meshed with the ring gear 34. Conversely, FIG. 7 shows the latch pin 62' engaging an opposite side of the toggle arm 56 for retaining the shift lever 54 in the reverse-drive position with the second output gear 52 meshed with the ring gear 34. This wire-type spring latch 62 is relatively stiff in a circumferential direction to engage and retain the toggle arm 56 and the associated shift mechanism 32 in the appropriate forward-drive or reverse-drive position. However, the spring latch 62 is relatively flexible in a radial direction to accommodate retraction from engagement with the toggle arm 56 when shifting movement is desired. Alternative spring-type and other latch configurations will be apparent to those skilled in the art.

The outboard ends of the toggle arm 56 and the trip spring 60 are positioned for engagement by the limit stops 36 and 38 as the ring gear 34 and spray head 16 rotate back and forth between the predetermined end limits of part-circle rotation. FIGS. 3 and 4 illustrate clockwise or forward-drive rotation of the ring gear 34 to displace the limit stop 36 progressively toward a position engaging the shift mechanism. In this regard, the limit stop 36 is shaped to include a leading edge 64 for initially engaging the outboard free end of the reverse trip spring 60, without engaging the toggle arm 56. With this construction, forward-drive rotation of the ring gear 34 continues beyond the point of initial engagement with the trip spring 60, resulting in deflection and loading of the trip spring relative to the toggle arm 56, as viewed in FIG. 6. The thus-deflected trip spring 60 applies a spring torque to the toggle arm 56 and associated shift lever 54 in a direction urging the shift mechanism to move the gear carrier 40 from the forward-drive to the reverse-drive position. However, such shifting movement is initially prevented by the latch pin 62' which remains in engagement with one side of the toggle arm 56 (FIGS. 4 and 6).

Continued forward-drive rotation of the ring gear 34 moves the limit stop 36 into contact with the latch pin 62'. More particularly, as viewed best in FIG. 6, the leading edge 64 of the limit stop 36 includes an outer ramped cam 66 for engaging and radially retracting the latch pin 62'. Forward-drive rotation of the ring gear 34 displaces this ramped cam 66 to engage and displace the latch pin 62' radially outwardly a sufficient distance to clear the end of the toggle arm 56. When this occurs, the toggle arm 56 and the shift lever 54 of the shift mechanism 32 are quickly and positively shifted from the first, forward-drive position to the second, reverse-drive position by the already-loaded reverse trip spring 60 (as viewed in FIG. 7). This shifts the gear carrier 40 to the reverse-drive position, with the second output gear 52 engaged with the ring gear 34 to rotatably drive the ring gear and spray head in an opposite, counter-clockwise direction. The latch 62 is radially spring-loaded to return into engagement with an opposite side edge of the toggle arm 56, as viewed in FIG. 7, following shifting displacement of the gear carrier 40.

In the event that friction and/or other forces are sufficient to resist this desired shifting displacement of the toggle arm 56 and shift lever 54 from the forward-drive to the reverse-drive position, a stop tab 68 is formed on the limit stop 36 to positively initiate shifting displacement. The stop tab 68 (FIGS. 3–8) and projects upwardly from the limit stop 36 at a trailing edge thereof, to engage a side edge of the toggle arm 56 opposite the latch pin 62'. If frictional resistance forces attributable to the accumulation of grit and like between moving parts is sufficient to resist spring-loaded shifting of the gear carrier 40 when the latch pin 62' is moved radially outwardly from the toggle arm 56, continued forward-drive rotation of the ring gear 34 brings the upstanding stop tab 68 into engagement with the toggle arm as viewed in FIG. 8. Similarly, since the direction of rotation of the two output gears 50, 52 relative to the ring gear 34 tends to generate self-engaging reaction forces urging the gears to remain in meshed relation, continued forward-drive rotation of the ring gear 34 following latch retraction brings the stop tab 68 against the side edge of the toggle arm 56. The stop tab 68 bears against the toggle arm to positively initiate shifting displacement thereof. As soon as shifting displacement is initiated, to overcome any resistance forces, the torque load applied by the reverse trip spring 60 quickly and positively completes the shifting action by moving the gear carrier 40 from the forward-drive position through the neutral position to the opposite, reverse-drive position. As the second output gear 52 moves toward meshed relation with the ring gear 34, the relative direction of rotation causes those gears to self-engage.

In the reverse-drive position, the second output gear 52 drives the ring gear 34 and spray head 16 in a reverse or counter-clockwise direction. Such rotation displaces the other limit stop 38 toward and into engagement with the shift mechanism 32. Specifically, the other limit stop 38 is constructed as a mirror image of the above-described trip stop 36 to include a leading edge 64 for initially engaging and loading the reversing trip spring 60. As the trip spring 60 is loaded, a ramped cam 66 on the limit stop 38 engages and retracts the latch pin 62' to release the toggle arm 56 and shift lever 54 for positive spring-loaded shifting displacement from the reverse-drive position (FIG. 6) back to the forward-drive position (FIGS. 3–4). In the event that friction or other forces resist initial shifting displacement, an upstanding stop tab 68 on the limit stop 38 engages the toggle arm 56 to positively initiate the desired shifting action.

In accordance with one important aspect of the invention, the reverse trip spring 60 is loaded by engagement with the leading edge 64 of the associated limit stop 36 or 38 to apply a substantial spring force or torque to the shift mechanism 32 prior to movement of the latch 62 to release the toggle arm 56. At the moment of latch release, the reverse trip spring 60 applies this spring force or torque to the shift mechanism by physically pulling on the end of the shift lever 54. The magnitude of the applied torque is a maximum at the moment of latch release. This results in a rapid and positive snap-action displacement of the shift mechanism from the forward-drive to the reverse-drive position, or vice versa, as appropriate, substantially without any significant risk of the shift mechanism hanging up or stalling in a neutral position with both of the output gears 50, 52 on the gear carrier 40 disengaged from the ring gear 34. This arrangement is contrasted with prior available reverse gear driving systems of the type using over-center springs to displace a shift mechanism, wherein the magnitude of the applied spring force is not maximized at the moment of initial shift mechanism displacement.

A variety of modifications and improvements in and to the reverse gear driving system of the present invention will be apparent to those persons skilled in the art. Accordingly, no limitation on the invention is intended by way of the foregoing description and accompanying drawings, except as set forth in the appended claims.

What is claimed is:

1. A reversing gear drive system for an irrigation sprinkler having rotary drive means for rotatably driving a spray head, said reversing gear drive system, comprising:

a gear carrier having a drive gear rotatably driven by the rotary drive means, and first and second output gears rotatably driven by said drive gear in opposite directions;

a shift mechanism movable between first and second positions for respectively shifting said gear carrier between a forward-drive position with said first output gear rotatably driving the spray head in a forward direction, and a reverse-drive position with said second output gear rotatably driving the spray head in a reverse direction; and stop means defining opposite end limits of a predetermined part-circle path of rotation for the spray head;

said shift mechanism including a reverse trip spring engaged by said stop means upon spray head rotation substantially to each of said opposite end limits of said predetermined part-circle path, said trip spring being loaded upon engagement with said stop means to apply a reversing spring force to move said shift mechanism between said first and second positions to correspondingly shift-said gear carrier between said forward-drive and reverse-drive positions.

2. The reversing gear drive system of claim 1 further including at least one latch for releasibly retaining said shift mechanism in each of said first and second positions, said latch being engaged by said stop means upon spray head rotation substantially to each of said opposite end limits and subsequent to loading of said trip spring to release said shift mechanism for spring-loaded shift movement between said first and second positions.

3. The reversing gear drive system of claim 2 wherein said stop means includes a ramped cam for engaging and radially retracting said latch from said shift mechanism upon spray head rotation substantially to each of said opposite end limits, said latch being spring-loaded for re-engagement with said shift mechanism following said spring-loaded shift movement of said shift mechanism between said first and second positions.

4. The reversing gear drive system of claim 1 wherein said gear carrier includes at least one idler gear meshed between said drive gear and one of said first and second output gears, and further wherein the difference between the number of said idler gears meshed between said drive gear and said first output gear versus the number of said idler gears meshed between said drive gear and said second output gear is an odd number.

5. The reversing gear drive system of claim I wherein said shift mechanism comprises a shift lever extending outwardly from said gear carrier and terminating in a radially outwardly extending toggle arm, and further wherein said stop means comprises a pair of arcuately spaced limit stops mounted for rotation with the spray head and respectively defining said opposite end limits, said trip spring being deflected and loaded upon engagement with each of said limit stops to apply said reversing spring force to shift said shift mechanism between said first and second positions.

6. The reversing gear drive system of claim 5 wherein said shift lever has a generally nonlinear configuration.

7. The reversing gear drive system of claim 5 wherein said reverse trip spring projects generally radially outwardly from said shift lever.

8. The reversing gear drive system of claim 7 wherein said reverse trip spring comprises a torsion spring having a coil and first and second spring legs projecting from said coil in opposite directions, said first leg being connected to said shift lever, and said second leg projecting generally radially outwardly from said coil.

9. The reversing gear drive system of claim 7 wherein said reverse trip spring is disposed in spaced and generally parallel relation to said toggle arm.

10. The reversing gear drive system of claim 7 wherein said reverse trip spring projects outwardly from said shift lever in cantilevered relation thereto.

11. The reversing gear drive system of claim 7 wherein each of said limit stops includes a leading edge for engaging and loading said reverse trip spring.

12. The reversing gear drive system of claim 11 further including a latch for releasibly engaging said toggle arm to retain said shift mechanism in each of said first and second positions, and further wherein each of said limits stops includes a ramped cam for engaging and retracting said latch from said toggle arm to release said shift lever following engagement of said leading edge with said trip spring, to release said shift mechanism for spring-loaded shift movement between said first and second positions.

13. The reversing gear drive system of claim 12 wherein said latch is spring-loaded for re-engagement with said toggle arm following movement of said shift mechanism between said first and second positions to shift said gear carrier between said forward-drive and reverse-drive positions.

14. The reversing gear drive system of claim 12 wherein each of said limit stops further includes a stop tab for positively engaging and initiating spring-loaded shift displacement of said toggle arm following engagement of said leading edge with said trip spring.

15. The reversing gear drive system of claim 14 wherein said stop tab on each of said limit stops engages said toggle arm subsequent to retraction of said latch from said toggle arm.

16. The reversing gear drive system of claim 1 further including a ring gear driven in opposite rotational directions by said first and second output gears for rotatably driving said spray head.

17. A reversing gear drive system for an irrigation sprinkler having rotary drive means for rotatably driving a spray head, said reversing gear drive system, comprising:

a gear carrier having a drive gear rotatably driven by the rotary drive means, and first and second output gears rotatably driven by said drive gear in opposite directions, said gear carrier including at least one idler gear meshed between said drive gear and one of said first and second output gears, and further wherein the difference between the number of said idler gears meshed between said drive gear and said first output gear versus the number of said idler gears meshed between said drive gear and said second output gear is an odd number;

a ring gear driven in opposite rotational directions by said first and second output gears for rotatably driving said spray head;

a shift mechanism movable between first and second positions for respectively shifting said gear carrier between a forward-drive position with said first output gear rotatably driving said ring gear in a forward direction, and a reverse-drive position with said second output gear rotatably driving said ring gear in a reverse direction, said shift mechanism including a shift lever extending outwardly from said gear carrier and terminating in a radially outwardly extending toggle arm;

a pair of arcuately spaced limit stops mounted for rotation with the spray head and defining opposite end limits of a predetermined part-circle path of rotation for the spray head;

said shift mechanism including a reverse trip spring engaged by each of said limit stops upon spray head rotation substantially to each of said opposite end limits of said predetermined part-circle path, said trip spring being loaded upon engagement with said stop means to apply a reversing spring force to move said shift mechanism between said first and second positions to correspondingly shift said gear carrier between said forward-drive and reverse-drive positions; and at least one latch for releasibly retaining said toggle arm with said shift mechanism in each of said first and second positions, said latch being engaged by each of said limit stops upon spray head rotation substantially to each of said opposite end limits and subsequent to loading of said trip spring to release said shift mechanism for spring-loaded shift movement between said first and second positions.

18. The reversing gear drive system of claim 17 wherein each of said limit stops includes a ramped cam for engaging and radially retracting said latch from said toggle arm upon spray head rotation substantially to each of said opposite end limits, said latch being spring-loaded for re-engagement with said toggle arm following said spring-loaded shift movement of said shift mechanism between said first and second positions.

19. The reversing gear drive system of claim 17 wherein said shift lever has a generally nonlinear configuration.

20. The reversing gear drive system of claim 17 wherein said reverse trip spring projects generally radially outwardly from said shift lever.

21. The reversing gear drive system of claim 17 wherein each of said limit stops further includes a stop tab for positively engaging said toggle arm and initiating spring-loaded shift displacement of said shift mechanism following engagement of said limit stop edge with said trip spring.

22. The reversing gear drive system of claim 21 wherein said stop tab on each of said limit stops engages said toggle arm subsequent to retraction of said latch from said toggle arm.

23. A reversing gear drive system for an irrigation sprinkler having rotary drive means for rotatably driving a spray head, said reversing gear drive system, comprising:

a gear carrier having an odd idler gear drive system including a drive gear rotatably driven by the rotary drive means, and first and second output gears rotatably driven in opposite directions;

shift lever means movable between first and second positions for respectively shifting said gear carrier between a forward-drive position with said first output gear rotatably driving the spray head in a forward direction, and a reverse-drive position with said second output gear rotatably driving the spray head in a reverse direction;

stop means defining opposite end limits of a predetermined part-circle path of rotation for the spray head; and a reverse trip spring carried by said shift lever means and engaged by said stop means upon spray head rotation substantially to each of said opposite end limits of said predetermined part-circle path, said reverse trip spring being loaded upon engagement by said stop means to apply a reversing force to move said shift lever means between said first and second positions to correspondingly shift said gear carrier between said forward-drive and reverse-drive positions.

24. The reversing gear drive system of claim 23 further including at least one latch for releasibly retaining said shift lever means in each of said first and second positions, said latch being engaged by said stop means upon spray head rotation substantially to each of said opposite end limits and subsequent to loading of said trip spring to release said shift lever means for spring-loaded shift movement between said first and second positions.

25. The reversing gear drive system of claim 24 wherein said stop means includes a ramped cam for engaging and radially retracting said latch from said shift lever means upon spray head rotation substantially to each of said opposite end limits, said latch being spring-loaded for re-engagement with said shift lever means following said spring-loaded shift movement of said shift mechanism between said first and second positions.

26. The reversing gear drive system of claim 24 wherein said stop means comprises a pair of arcuately spaced limit stops mounted for rotation with the spray head and respectively defining said opposite end limits, and further wherein said reverse trip means comprises a reverse trip spring being deflected and loaded upon engagement with each of said limit stops to apply said reversing spring force to shift said shift mechanism between said first and second positions.

27. The reversing gear drive system of claim 26 wherein said reverse trip spring comprises a torsion spring having a coil and first and second spring legs projecting from said coil in opposite directions, said first leg being connected to said shift lever means, and said second leg comprising a free end projecting outwardly from said coil.

28. The reversing gear drive system of claim 26 wherein each of said limit stops further includes a stop tab for positively engaging and initiating spring-loaded shift displacement of said shift lever means following engagement thereof with said reverse trip means.

29. The reversing gear drive system of claim 28 wherein said stop tab on each of said limit stops engages said shift lever means subsequent to release of said latch therefrom.

* * * * *